US009178325B2

(12) United States Patent
Soo

(10) Patent No.: US 9,178,325 B2
(45) Date of Patent: Nov. 3, 2015

(54) LOW PROFILE CONNECTOR

(71) Applicant: Molex Incorporated, Lisle, IL (US)

(72) Inventor: Foong-Ching Soo, Singapore (SG)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/185,459

(22) Filed: Feb. 20, 2014

(65) Prior Publication Data

US 2014/0315432 A1 Oct. 23, 2014

(30) Foreign Application Priority Data

Feb. 20, 2013 (CN) ..... 2013 2 0079316 U

(51) Int. Cl.

| | |
|---|---|
| ***H01R 24/00*** | (2011.01) |
| ***H01R 29/00*** | (2006.01) |
| ***H01R 12/72*** | (2011.01) |
| ***H01R 12/70*** | (2011.01) |
| ***H01R 13/703*** | (2006.01) |

(52) U.S. Cl.

CPC ..... *H01R 29/00* (2013.01); *H01R 12/7094* (2013.01); *H01R 12/72* (2013.01); *H01R 12/722* (2013.01); *H01R 13/7032* (2013.01)

(58) Field of Classification Search

CPC ..... H01R 13/703; H01R 13/70
USPC ..... 439/626, 180, 630
See application file for complete search history.

(56) References Cited

U.S. PATENT DOCUMENTS

| | | | | |
|---|---|---|---|---|
| 4,900,273 | A * | 2/1990 | Pernet | 439/630 |
| 5,013,255 | A * | 5/1991 | Juret et al. | 439/260 |
| 6,126,464 | A * | 10/2000 | Chang | 439/188 |
| 6,179,638 | B1 * | 1/2001 | Lim | 439/260 |
| 6,267,619 | B1 * | 7/2001 | Nishioka | 439/489 |
| 6,326,568 | B2 | 12/2001 | Martucci et al. | |
| 7,101,207 | B1 | 9/2006 | Chi-Te | |
| 7,427,206 | B2 | 9/2008 | Takei et al. | |
| 8,197,272 | B2 | 6/2012 | Matsunaga | |
| 2011/0117762 | A1 | 5/2011 | Beak et al. | |

FOREIGN PATENT DOCUMENTS

| | | |
|---|---|---|
| CN | 201081824 Y | 7/2008 |
| CN | 201278378 Y | 7/2009 |
| CN | 201523134 U | 7/2010 |

* cited by examiner

*Primary Examiner* — Neil Abrams
*Assistant Examiner* — Travis Chambers
(74) *Attorney, Agent, or Firm* — Stephen L. Sheldon

(57) ABSTRACT

An electrical connector comprises a housing having a front side and a rear side, a cage and a detection switch. The cage is engaged with the housing, the cage and the housing together define a slot, and an entrance of the slot is adjacent to the front side so as to allow an electronic card to enter into the slot along a card insertion direction. The detection switch is provided to the housing and comprises a first resilient terminal and a second resilient terminal. The second end portion is further adjacent to the front side relative and when the electronic card is received in the slot, the first resilient arm portion is separated from the second end portion.

9 Claims, 13 Drawing Sheets

LOW PROFILE CONNECTOR

RELATED APPLICATIONS

This application claims priority to Chinese Application No. 201320079316.5, filed Feb. 20, 2013, which is incorporated herein by reference in its entirety.

TECHNICAL FIELD

The present disclosure relates to an electrical connector, and particularly relates to an electrical connector having a detection switch.

BACKGROUND ART

Generally, an electrical connector for electrically connecting an electronic card is typically provided with a detection switch so as to judge whether the electronic card has been inserted. A detection switch in prior art typically comprises a fixed terminal and a resilient terminal, the fixed terminal and the resilient terminal are fixed to a housing (which is formed of an insulative material), and the resilient terminal partially extends into a slot of an electrical connector, and the resilient terminal is pushed by the electronic card inserted into the slot so as to change a contact state between the resilient terminal and the fixed terminal, and thus the detection switch can detect whether the electronic card has been inserted into the slot.

When the electronic card is not inserted into the slot, the resilient terminal and the fixed terminal contact each other, which is referred to as a normal close, or the resilient terminal and the fixed terminal are separated from each other, which is referred to as a normal open. Here, as for the normal close, the resilient terminal and the fixed terminal will be separated from each other when the electronic card has been inserted into the slot; as for the normal open, the resilient terminal and the fixed terminal will contact each other when the electronic card has been inserted into the slot.

Because only the resilient terminal with respect to the normal close has a predetermined preloaded force, a stable contact between the resilient terminal and the fixed terminal can be maintained. However, if the preloaded force exerted on the fixed terminal by the resilient terminal is too small, a poor connection will occur; if the preloaded force exerted on the fixed terminal by the resilient terminal is too large, the preloaded force will be transferred to the housing, which can cause the housing to warp after passing through reflow. If the preloaded force is exerted on a position of terminals close to a soldering region, coplanarity of soldering portions of the terminals can be affected.

SUMMARY OF THE INVENTION

According to an embodiment of the present disclosure, an electrical connector of the present disclosure comprises an housing, a cage and a detection switch. The housing has a front side and a rear side which are opposite. The cage is engaged with the housing, the cage and the housing together defines a slot, and an entrance of the slot is adjacent to the front side so as to allow an electronic card to enter into and exit from the slot along a card insertion direction. The detection switch is provided to the housing and is adjacent to a side of the slot, the side extends along the card insertion direction, and the detection switch comprises a first resilient terminal and a second resilient terminal. The first resilient terminal has a first fixed portion fixed to the housing and positioned outside the slot, a first resilient arm portion extending from the first fixed portion toward the rear side and offsetting toward the slot, and a first end portion extending from a distal end of the first resilient arm portion and extending into the slot and adjacent to the rear side. The second resilient terminal has a second fixed portion fixed to the housing and positioned outside the slot, a second resilient arm portion extending from the second fixed portion toward the rear side and offsetting toward the slot, and a second end portion extending from a distal end of the second resilient arm portion. The second end portion is further adjacent to the front side relative to the first end portion, and when the electronic card is not inserted into the slot, the second end portion contacts the first resilient arm portion, when the electronic card is received in the slot, the first end portion is pushed by the electronic card and drives the first resilient arm portion to allow the first resilient arm portion to be separated from the second end portion.

In an embodiment, the first fixed portion and the second fixed portion respectively extend along the card insertion direction, and the second fixed portion is further adjacent to the slot relative to the first fixed portion.

In an embodiment, the first resilient terminal further has a first soldering portion extending from the first fixed portion and extending out of the housing, the second resilient terminal further has a second soldering portion extending from the second fixed portion and extending out of the housing.

In an embodiment, the second end portion extends into the slot.

According to an embodiment of the present disclosure, an electrical connector of the present disclosure comprises an housing, a cage, a first detection switch and a second detection switch. The housing has a front side and a rear side which are opposite and a spacer. The cage is engaged with the housing, the cage and the housing together defines a first slot and a second slot positioned respectively above and under the spacer, and an entrance of the first slot and an entrance of the second slot are adjacent to the front side so as to respectively allow an electronic card to enter into and exit from the first slot and the second slot along a card insertion direction. The first detection switch is provided to the housing and is adjacent to a side of the first slot, the side extends along the card insertion direction, and comprises a first resilient terminal and a second resilient terminal. The first resilient terminal has a first fixed portion fixed to the housing and positioned outside the first slot, a first resilient arm portion extending from the first fixed portion toward the rear side and offsetting toward the first slot, and a first end portion extending from a distal end of the first resilient arm portion and extending into the first slot and adjacent to the rear side. The second resilient terminal has a second fixed portion fixed to the housing and positioned outside the first slot, a second resilient arm portion extending from the second fixed portion toward the rear side and offsetting toward the first slot, and a second end portion extending from a distal end of the second resilient arm portion. The second end portion is further adjacent to the front side relative to the first end portion, and when the electronic card is not inserted into the first slot, the second end portion contacts the first resilient arm portion, when the electronic card is received in the first slot, the first end portion is pushed by the electronic card and drives the first resilient arm portion so as to allow the first resilient arm portion to be separated from the second end portion. The second detection switch is provided to the housing and is adjacent to a side of the second slot, the side extends along the card insertion direction, and the second detection switch comprises a third resilient terminal and a fourth resilient terminal. The third resilient terminal has a third fixed portion fixed to the housing and positioned outside the second slot, a third resilient arm portion extending from the third fixed portion toward the rear side and offsetting toward the second slot, and a third end portion extending from a distal end of the third resilient arm portion and extending into the second slot and adjacent to the rear side. The fourth resilient terminal has a fourth fixed portion fixed to the housing and positioned outside the second slot, a fourth resilient arm portion extending from the fourth fixed portion toward the rear side and offsetting toward the second slot, and a fourth end portion extending from a distal end of the fourth resilient arm portion. The fourth end portion is further adjacent to the front side relative to the third end portion, and when the electronic card is not inserted into the second slot, the fourth end portion contacts the third resilient arm portion, when the electronic card is received in the second slot, the third end portion is pushed by the electronic card and drives the third resilient arm portion so as to allow the third resilient arm portion to be separated from the fourth end portion.

In an embodiment, the first fixed portion, the second fixed portion, the third fixed portion and the fourth fixed portion respectively extend along the card insertion direction, and the second fixed portion is further adjacent to the first slot relative to the first fixed portion, the fourth fixed portion is further adjacent to the second slot relative to the third fixed portion.

In an embodiment, the first resilient terminal further has a first soldering portion extending from the first fixed portion and extending out of the housing, the second resilient terminal further has a second soldering portion extending from the second fixed portion and extending out of the housing, the third resilient terminal further has a third soldering portion extending from the third fixed portion and extending out of the housing, the fourth resilient terminal further has a fourth soldering portion extending from the fourth fixed portion and extending out of the housing.

In an embodiment, the first detection switch and the second detection switch are respectively provided to an upper surface and a lower surface of the spacer.

In an embodiment, the second end portion extends into the first slot, the fourth end portion extends into the second slot.

The effect of the present disclosure is: (the first) detection switch comprises the two resilient terminals, as in the normal state, the first resilient arm portion of the first resilient terminal abuts against the second end portion of the second resilient terminal, most of the preloaded force exerted by the first resilient terminal may be counteracted through elastic deformation of the second resilient terminal, so that the force exerted on the housing may be reduced, so as to reduce risk of warpage of the housing due to non-uniform force. Similarly, the second detection switch also comprises the two resilient terminals, and similarly, most of the preloaded force exerted by the third resilient terminal may be counteracted by the fourth resilient terminal, so as to reduce risk of warpage of the housing due to non-uniform force.

BRIEF DESCRIPTION OF THE DRAWINGS

The other features and effects of the present disclosure will be apparent through the embodiments in combination with the Figures, and in which.

DETAILED DESCRIPTION OF THE PREFERRED EMBODIMENTS

Figure 1:
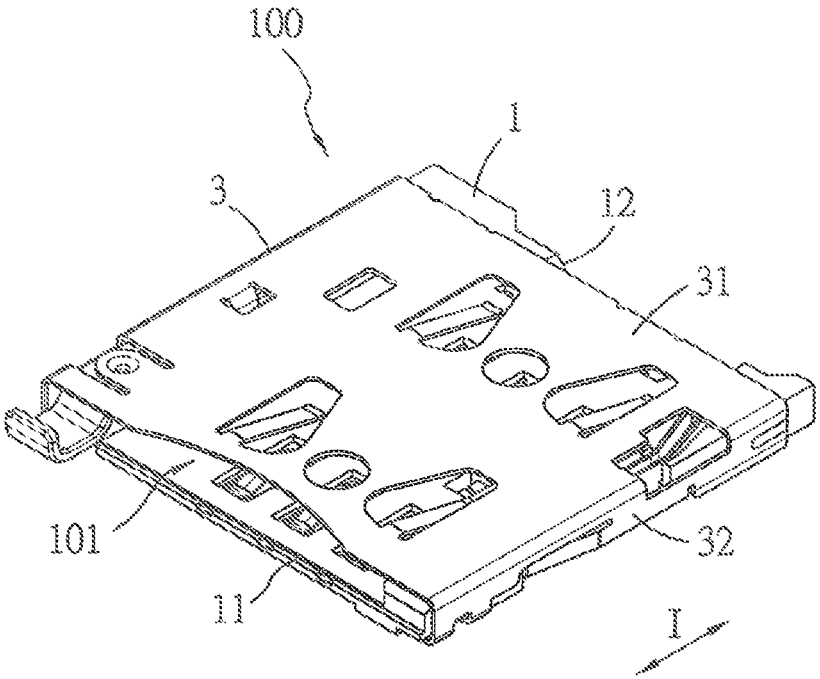
FIG. 1 is a perspective view illustrating a first embodiment of an electrical connector of the present disclosure.
Figure 2:
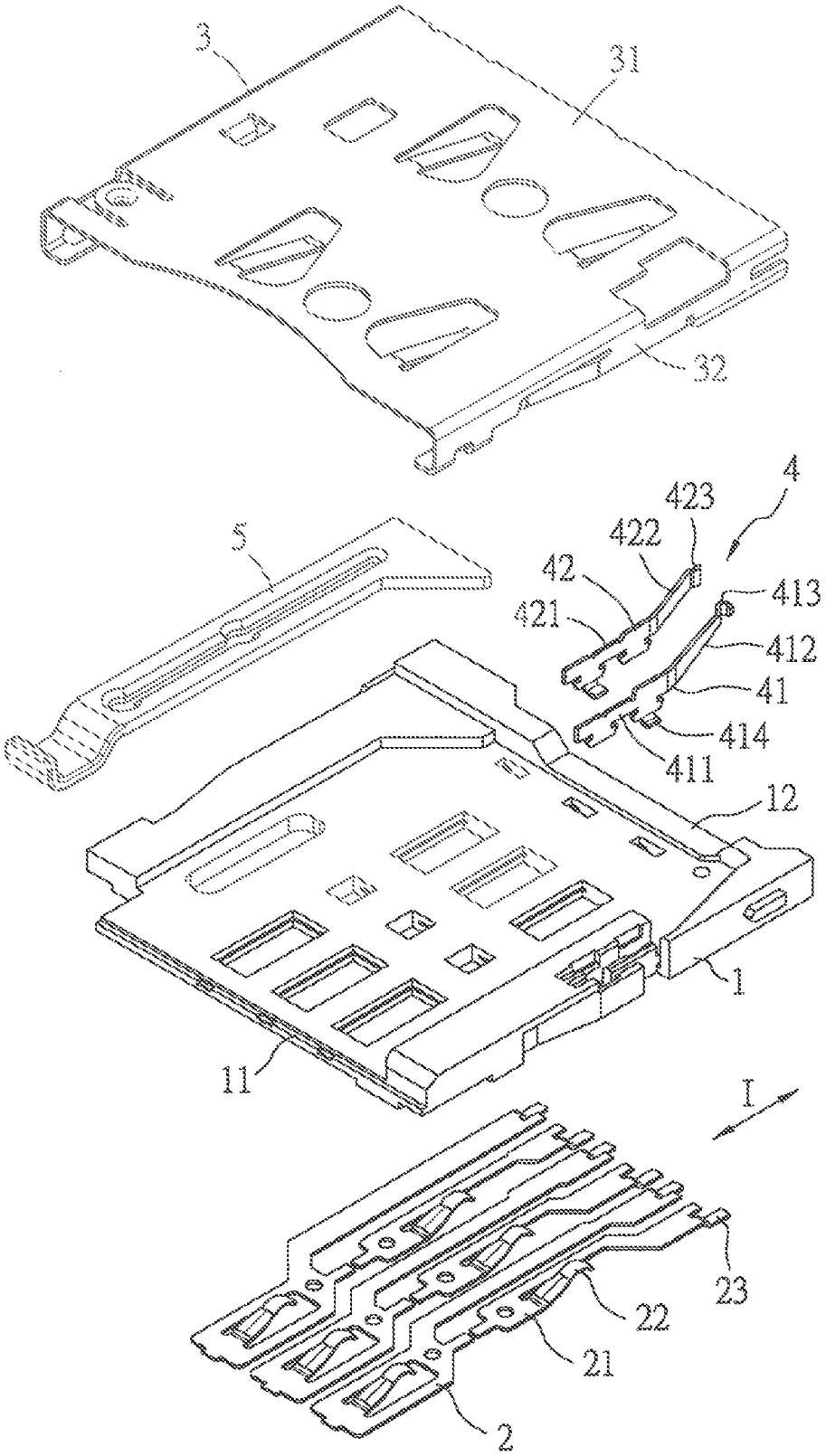
FIG. 2 is an exploded perspective view illustrating the first embodiment.

Before the present disclosure is described in detail, it should be noted that like elements are indicated by the same reference numerals in the following description. Therefore, an object of the present disclosure is to provide an electrical connector which can reduce warpage of an housing.

Referring to FIGS. 1-4, a first embodiment of an electrical connector 100 of the present disclosure comprises a housing 1 (formed of an insulative material), a plurality of terminals 2 provided to the housing 1, a cage 3, a detection switch 4 and a card ejecting mechanism 5.

The housing 1 has a front side 11 and a rear side 12 which are opposite. The terminals 2 are engaged with and fixed to the housing 1 by means of insert molding. The cage 3 has a top plate 31 and two side plates 32 extending respectively from opposite sides of the top plate 31. The cage 3 and the housing 1 are engaged and together define a slot 101, and an entrance of the slot 101 is adjacent to the front side 11 so as to allow an electronic card 8 to enter into and exist from the slot 101 along a card insertion direction I. The each terminal 2 has a fixed portion 21 embedded in the housing 1, a resilient contact portion 22 extending from the fixed portion 21 and extending into the slot 101, and a soldering portion 23 extending from the fixed portion 21 and exposed out from the rear side 12 of the housing 1 to be electrically connected to the circuit board (not shown).

The detection switch 4 is provided to the housing 1 and is adjacent to a side of the slot 101, the side extends along the card insertion direction I, and the detection switch 4 comprises a first resilient terminal 41 and a second resilient terminal 42. The first resilient terminal 41 has a first fixed portion 411, a first resilient arm portion 412, a first end portion 413 and a first soldering portion 414. The first fixed portion 411 is fixed to the housing 1 and is positioned outside the slot 101 and extends along the card insertion direction I. The first resilient arm portion 412 extends from the first fixed portion 411 toward the rear side 12 and offsets toward the slot 101. The first end portion 413 extends from a distal end of the first resilient arm portion 412 and extends into the slot 101 and is adjacent to the rear side 12. The first soldering portion 414 extends from the first fixed portion 411 and extends out of the housing 1 to be electrically connected to a circuit board. The second resilient terminal 42 has a second fixed portion 421, a second resilient arm portion 422, a second end portion 423 and a second soldering portion 424. The second fixed portion 421 is fixed to the housing 1 and positioned outside the slot 101 and extends along the card insertion direction I. The second fixed portion 421 is further adjacent to the slot 101 relative to the first fixed portion 411, that is, the second fixed portion 421 is positioned between the first fixed portion 411 and the slot 101. The second resilient arm portion 422 extends from the second fixed portion 421 toward the rear side 12 and offsets toward the slot 101. The second end portion 423 extends from a distal end of the second resilient arm portion 422 and is further adjacent to the front side 11 relative to the first end portion 413. The second soldering portion 424 extends from the second fixed portion 421 and extends out of the housing 1 to be electrically connected to the circuit board.

The card ejecting mechanism 5 is provided to a side opposite to the detection switch 4, and may slide along the card insertion direction I so as to eject the electronic card 8 from the slot 101.

Figure 3:
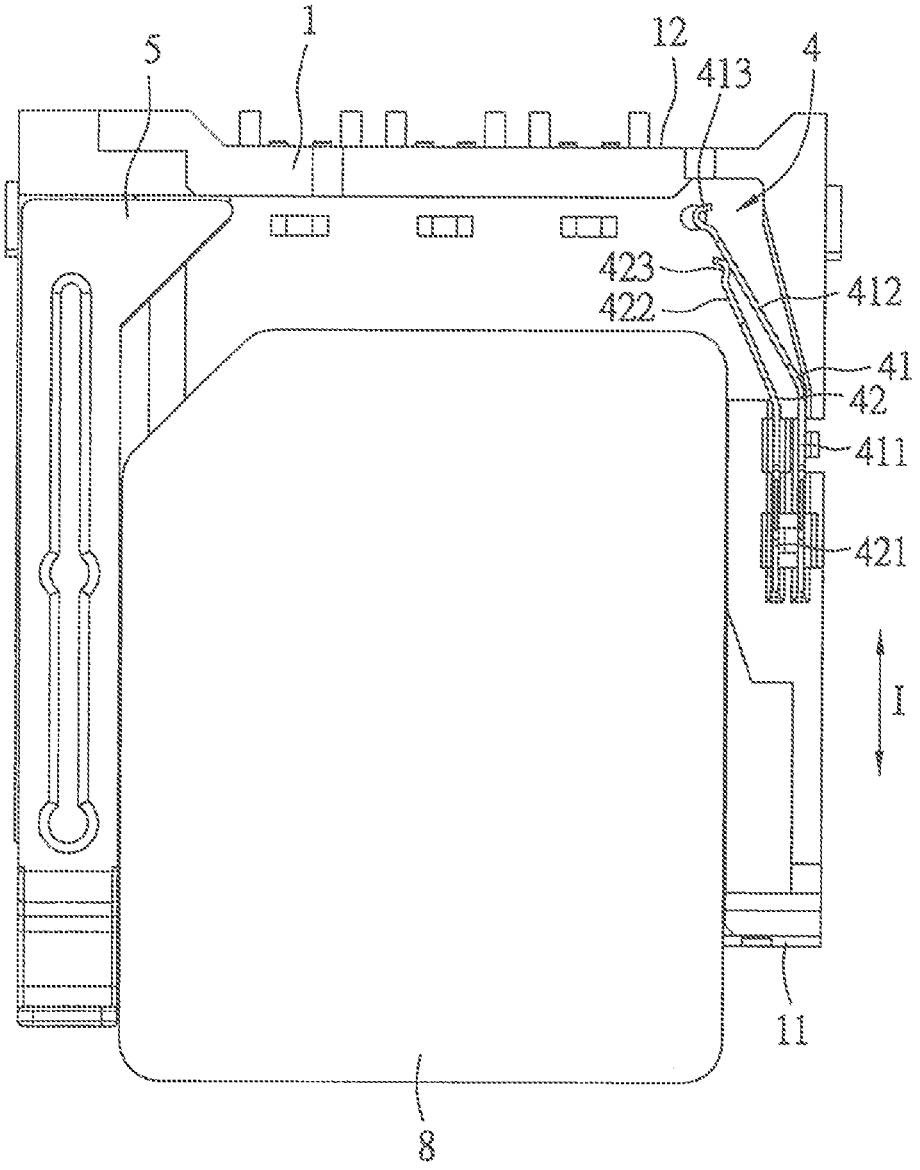
FIG. 3 is a top view illustrating a positional relationship among a detection switch, a slot and an housing of the first embodiment with a cage of the first embodiment not shown.
Figure 4:
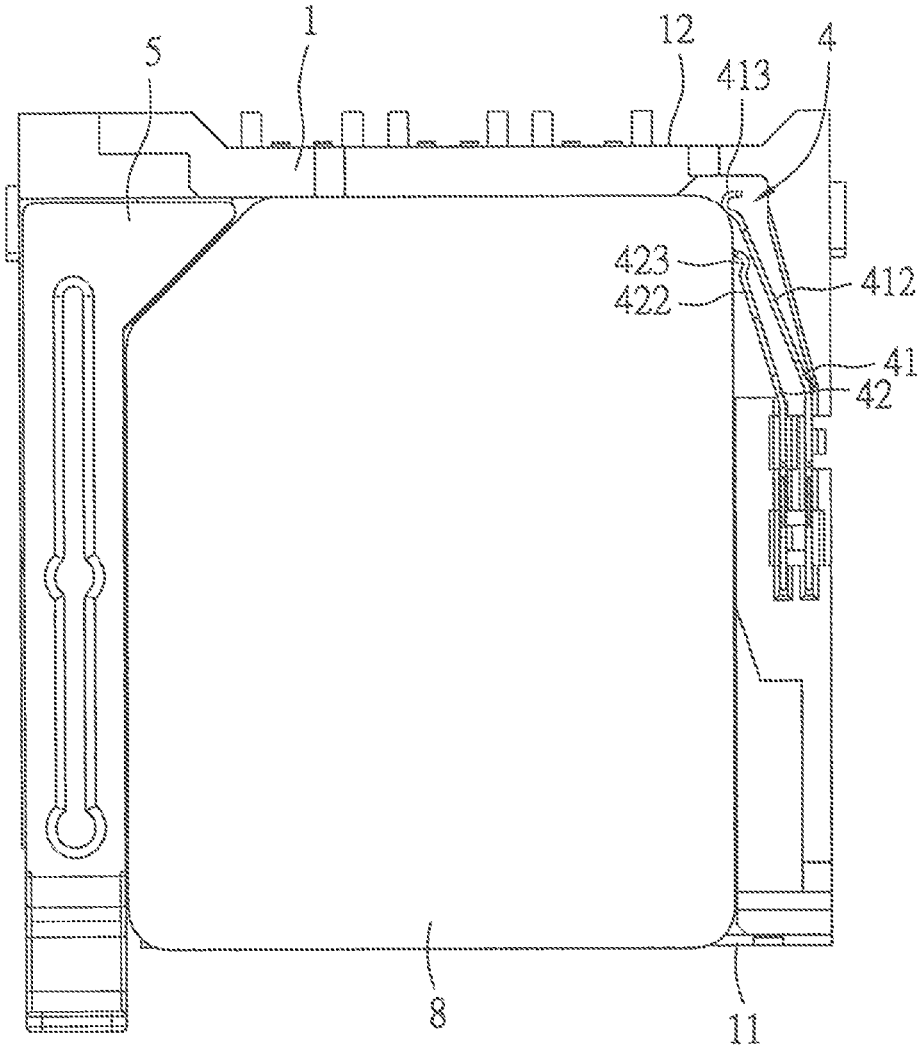
FIG. 4 is a view similar to FIG. 3 illustrating an operative relationship between the detection switch of the first embodiment and an electronic card.

Referring to FIG. 3, in the embodiment, when the electronic card 8 is not inserted into the slot 101, the second end portion 423 of the second resilient terminal 42 also extends into the slot 101 and is further adjacent to the front side 11 relative to the first end portion 413, and contacts the first resilient arm portion 412 so as to establish a normal close state. Referring to FIG. 4, when the electronic card 8 is inserted into the slot 101 along the card insertion direction I, during movement of the electronic card 8, the electronic card 8 firstly pushes the second end portion 423 toward the rear and toward the outside of the slot 101, at the same time, the second end portion 423 also drives the first resilient arm portion 412 and the first end portion 413, when the electronic card 8 moves further toward the rear side 12 and reaches a receiving position, that is when the electronic card 8 has been received in the slot 101, the first end portion 413 is pushed by the electronic card 8 and drives the first resilient arm portion 412, so as to allow the first resilient arm portion 412 to move further toward the rear and toward the outside of the slot 101 and in turn to be separated from the second end portion 423. That is, when the electronic card 8 reaches the receiving position and has been received in the slot 101, an electrical disconnection is established between the first resilient terminal 41 and the second resilient terminal 42 of the detection switch 4, which therefore can detect that the electronic card 8 has been inserted into slot 101 and has reached the receiving position.

As shown in FIG. 3, in the normal close state, the first resilient arm portion 412 of the first resilient terminal 41 abuts against the second end portion 423 of the second resilient terminal 42, most of the preloaded force exerted by the first resilient terminal 41 may be counteracted through elastic deformation of the second resilient terminal 42, so that the force exerted on the housing 1 may be reduced, so as to reduce risk of warpage of the housing 1 due to non-uniform force.

Figure 5:
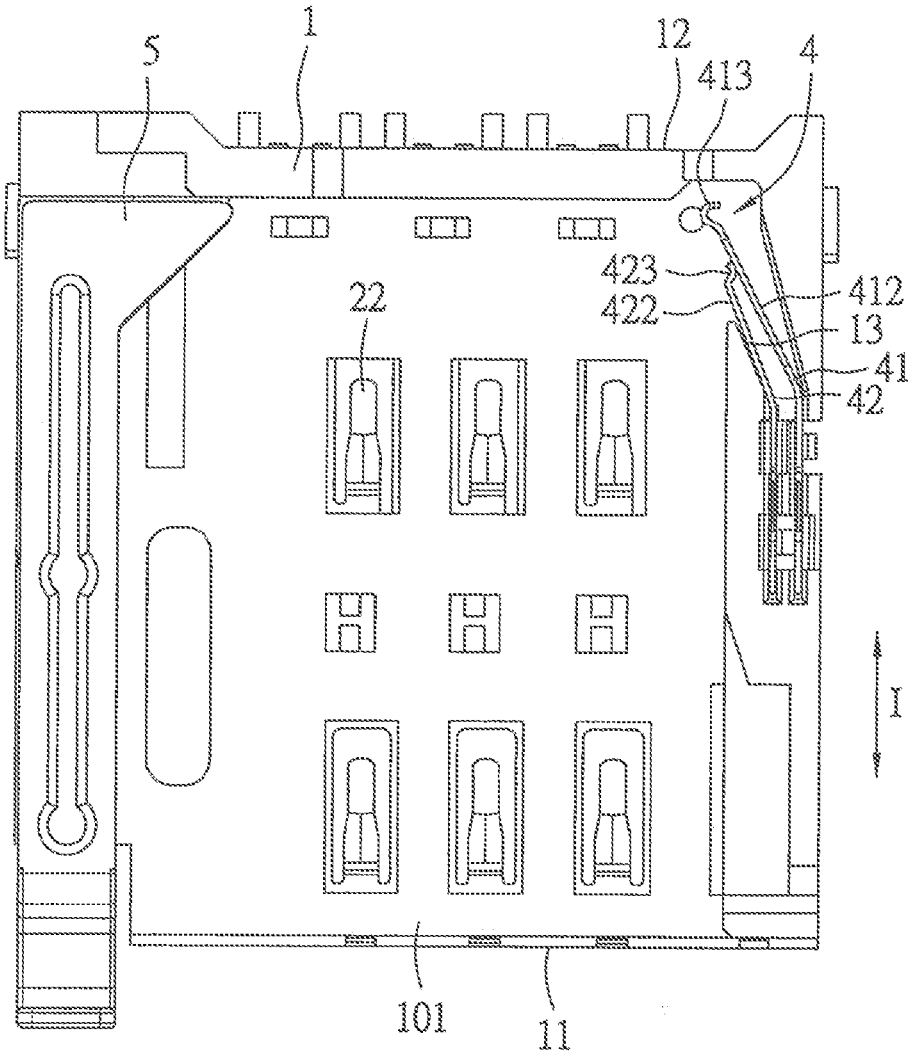
FIG. 5 is a view similar to FIG. 3 illustrating that an housing of a second embodiment of the electrical connector of the present disclosure is further formed with an abutting slope for a second resilient terminal of a detection switch to abut against.
Figure 6:
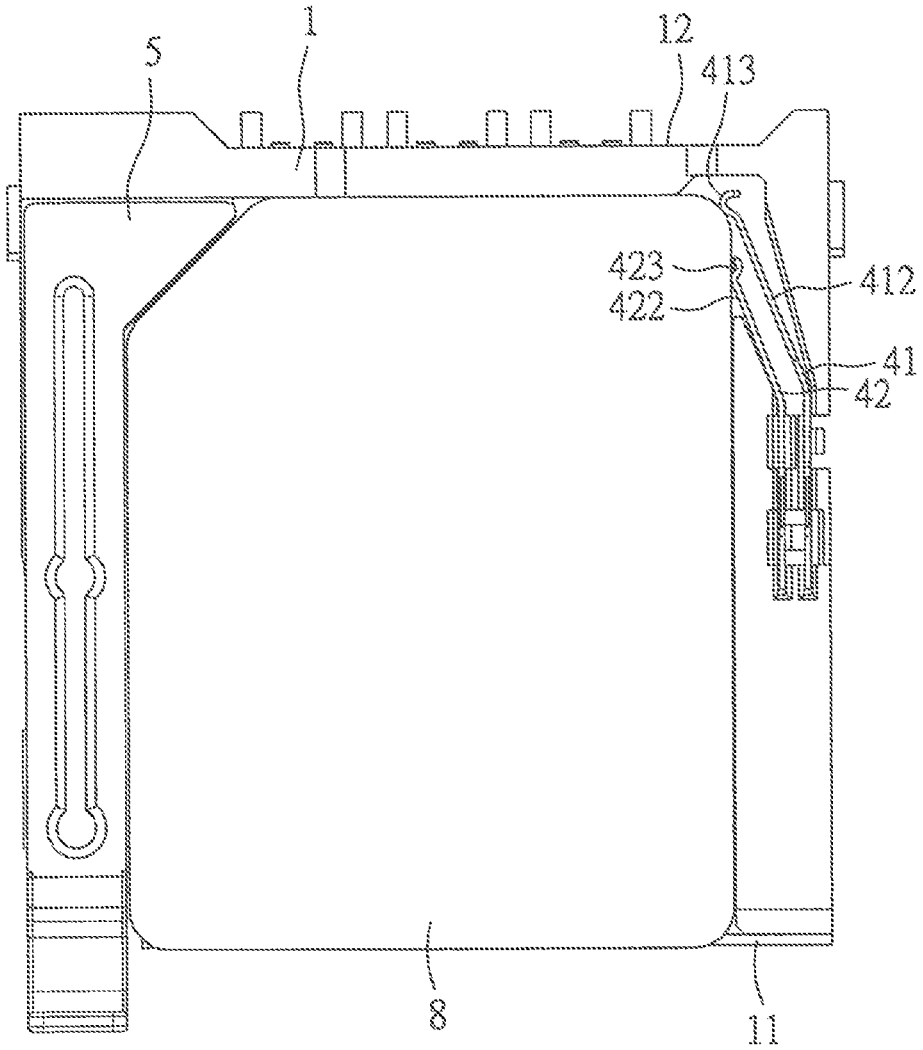
FIG. 6 is a view similar to FIG. 5 illustrating an operative relationship between the detection switch of the second embodiment and an electronic card.

Referring to FIG. 5 and FIG. 6, a second embodiment of the electrical connector 100 of the present disclosure is substantially the same as the first embodiment, however, the housing 1 is further formed with an abutting slope 13 for the second resilient arm portion 422 to abut against. This may be applicable to that the housing 1 has a good structural strength. And, as shown in FIG. 5, when the electronic card 8 is not inserted into the slot 101, the second end portion 423 may not extend into the slot 101, in this way, as shown in FIG. 6, when the electronic card 8 is inserted into the slot 101, the electronic card 8 does not push the second end portion 423, but only pushes the first end portion 413, so as to allow the first resilient arm portion 412 to be separated from the second end portion 423, which similarly achieves the effect of detecting the electronic card 8.

Figure 7:
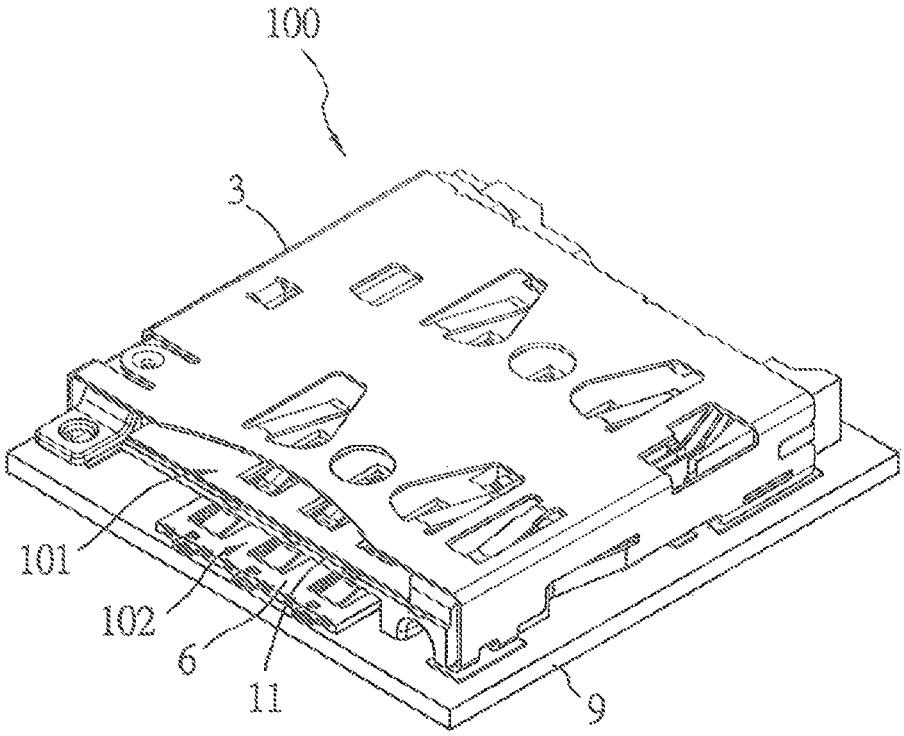
FIG. 7 is a perspective view illustrating a third embodiment of the electrical connector of the present disclosure.
Figure 8:
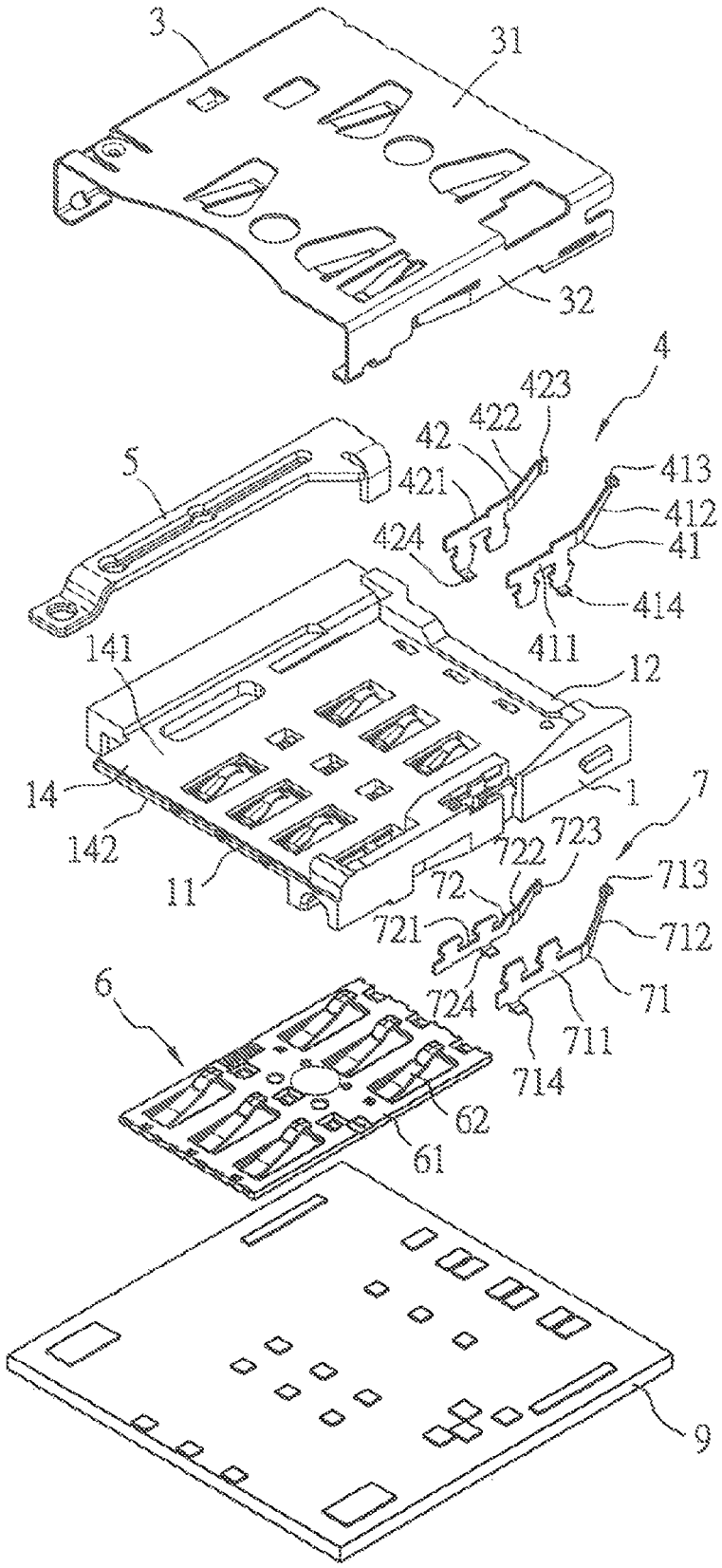
FIG. 8 is an exploded perspective view illustrating the third embodiment.
Figure 9:
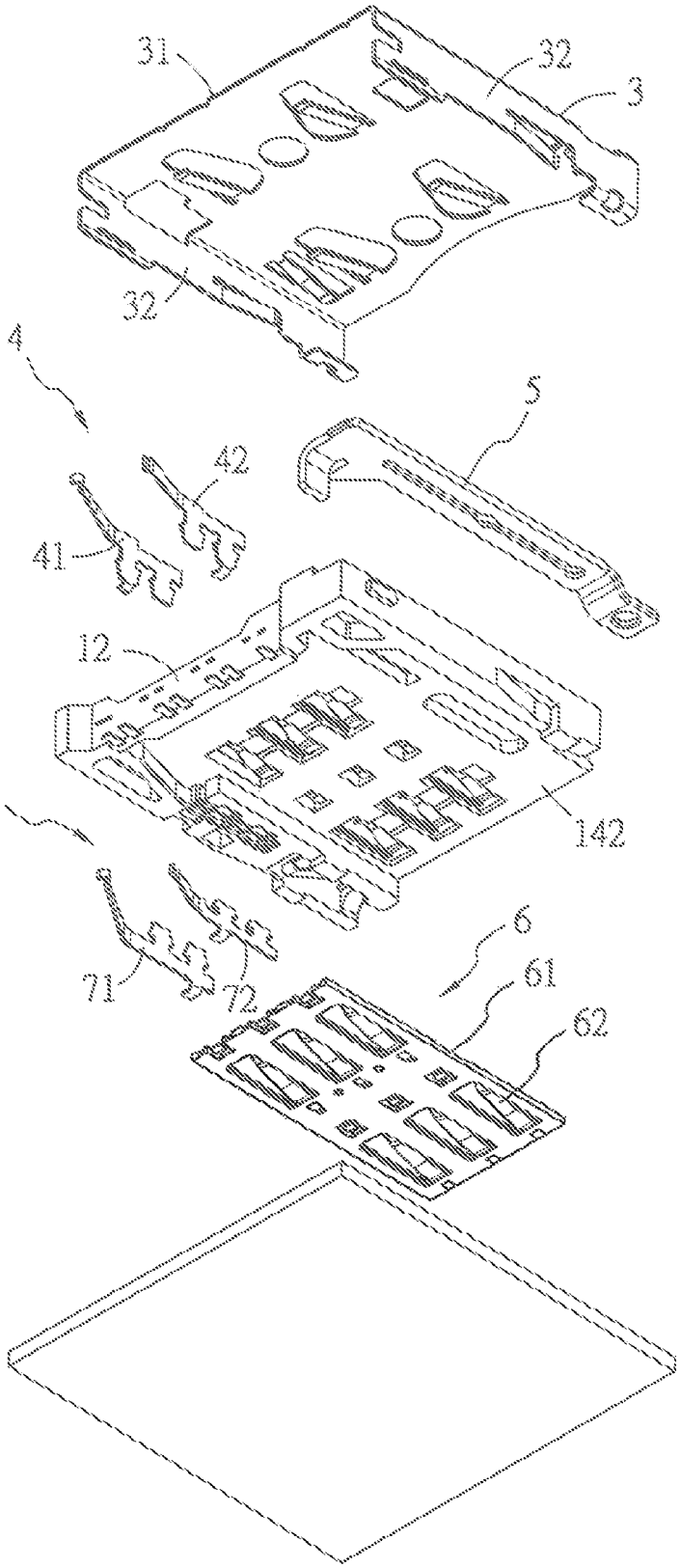
FIG. 9 is a view of FIG. 8 viewed from another angle.
Figure 11:
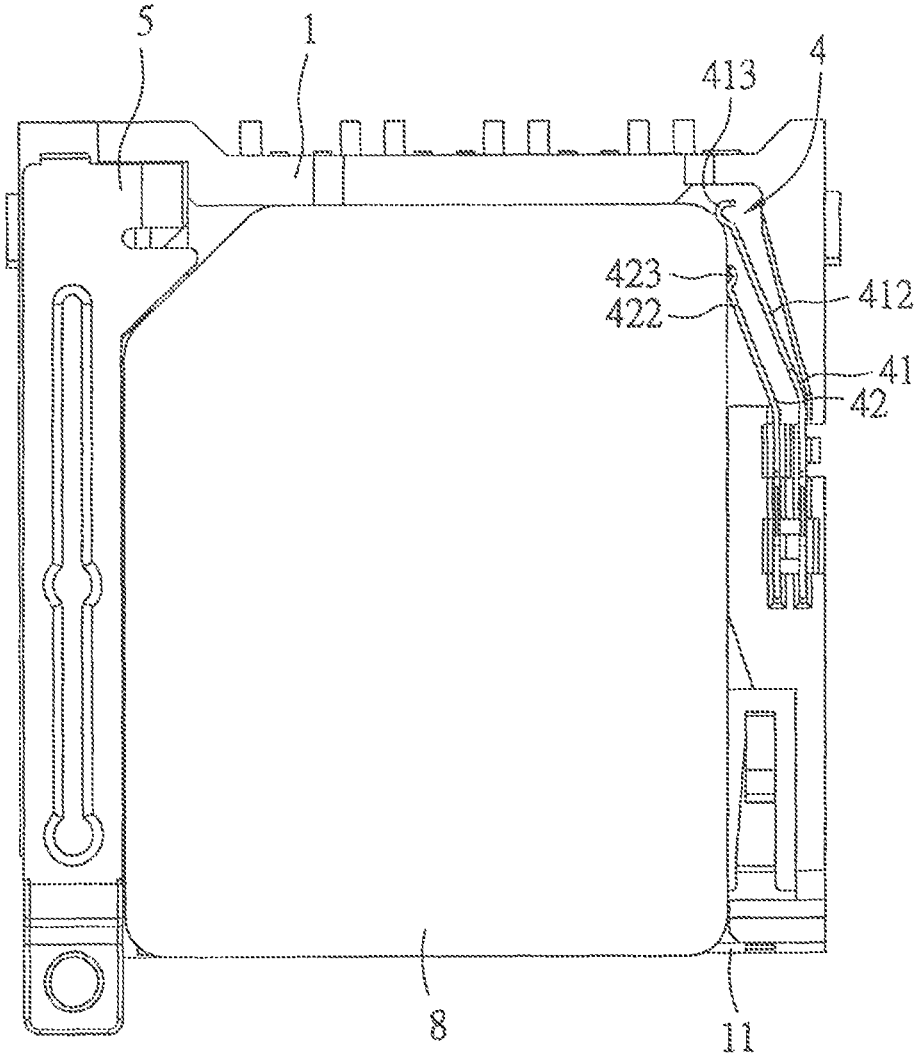
Figure 13:
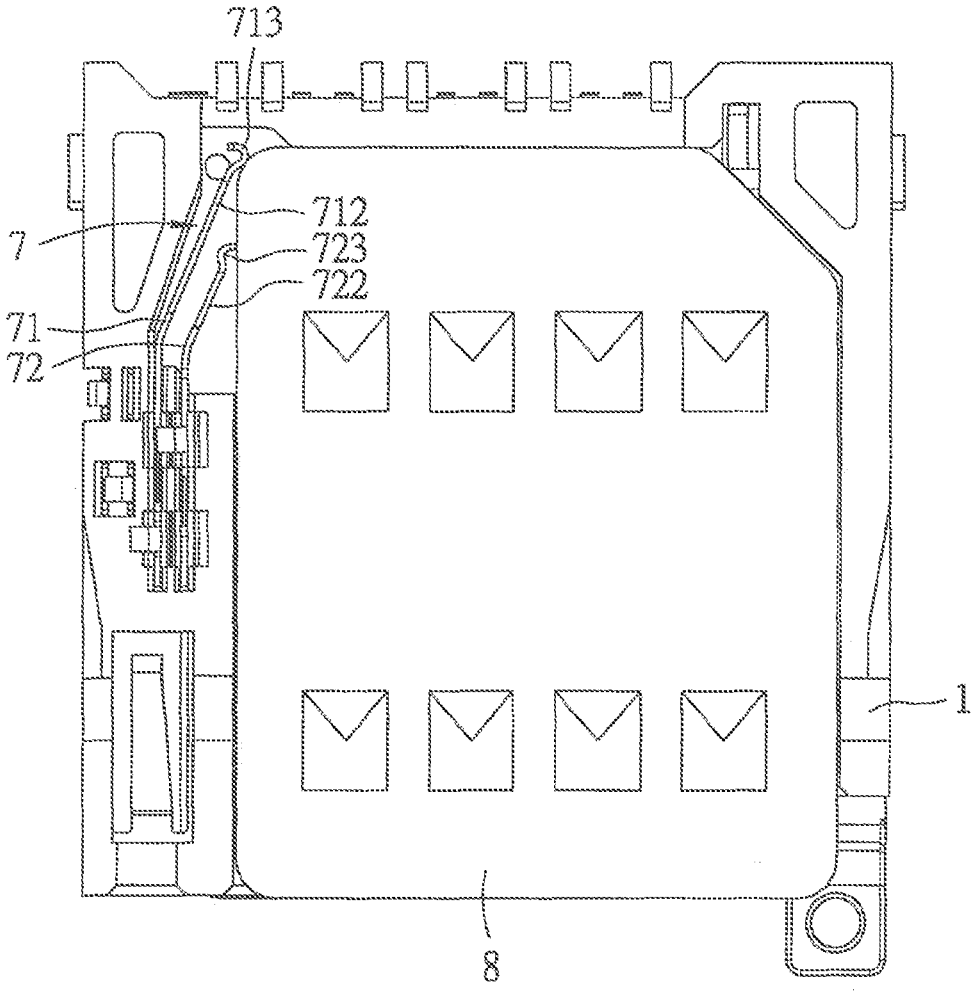
FIG. 13 are bottom views illustrating operative relationships between a second detection switch of the third embodiment and the electronic card.

Referring to FIGS. 7-9, a third embodiment of the electrical connector 100 of the present disclosure is provided on a circuit board 9, and has two slots 101, 102 for insertion of two electronic cards 8 (see FIG. 11 and FIG. 13). Specifically, in the embodiment, the electrical connector 100 comprises a housing 1, a plurality of first terminals 2 provided to the housing 1, a cage 3, a first detection switch 4, a card ejecting mechanism 5, a terminal block 6, and a second detection switch 7.

The housing 1 has a front side 11 and a rear side 12 which are opposite and a spacer 14. The terminal block 6 is provided on the circuit board 9 and is positioned under the spacer 14, and comprises an insulative base 61 and a plurality of second terminals 62, and the insulative base 61 is parallel to and spaced apart from the spacer 14. The cage 3 has a top plate 31 and two side plates 32 extending respectively from opposite sides of the top plate 31. The cage 3 and the housing 1 are engaged and together define a first slot 101 and a second slot 102 positioned respectively above and under the spacer 14, and an entrance of the first slot 101 and an entrance of the second slot 102 are adjacent to the front side 11 so as to respectively allow an electronic card 8 to enter into and exit from the slots 101, 102 along a card insertion direction I. In the embodiment, an upper boundary and a lower boundary of the second slot 102 are defined respectively by the spacer 14 and the insulative base 61. In the embodiment, although the insulative base 61 and the housing 1 are formed separately the insulative base 61 may be integrally formed with the housing 1, that is, the insulative base 61 may be a bottom plate which is integrally formed with the housing 1, thereby similarly having an effect of forming the second slot 102. Moreover, in the embodiment, the first terminals 2 and the second terminals 62 are respectively engaged with and fixed to the housing 1 and the insulative base 61 by means of insert molding.

Figure 10:
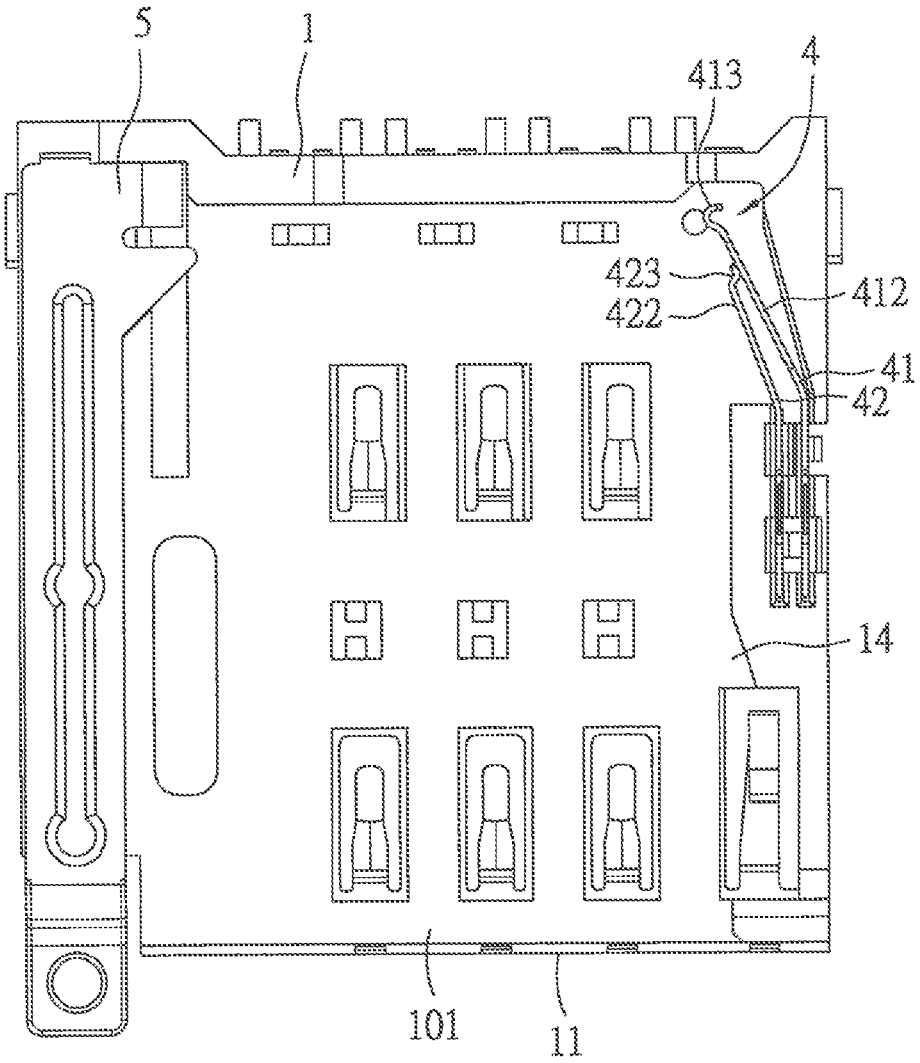
FIG. 10 and are top views illustrating operative relationships between a first detection switch of the third embodiment and an electronic card with a cage of the third embodiment not shown FIG. 11 are top views illustrating operative relationships between a first detection switch of the third embodiment and an electronic card with a cage of the third embodiment not shown.
Figure 12:
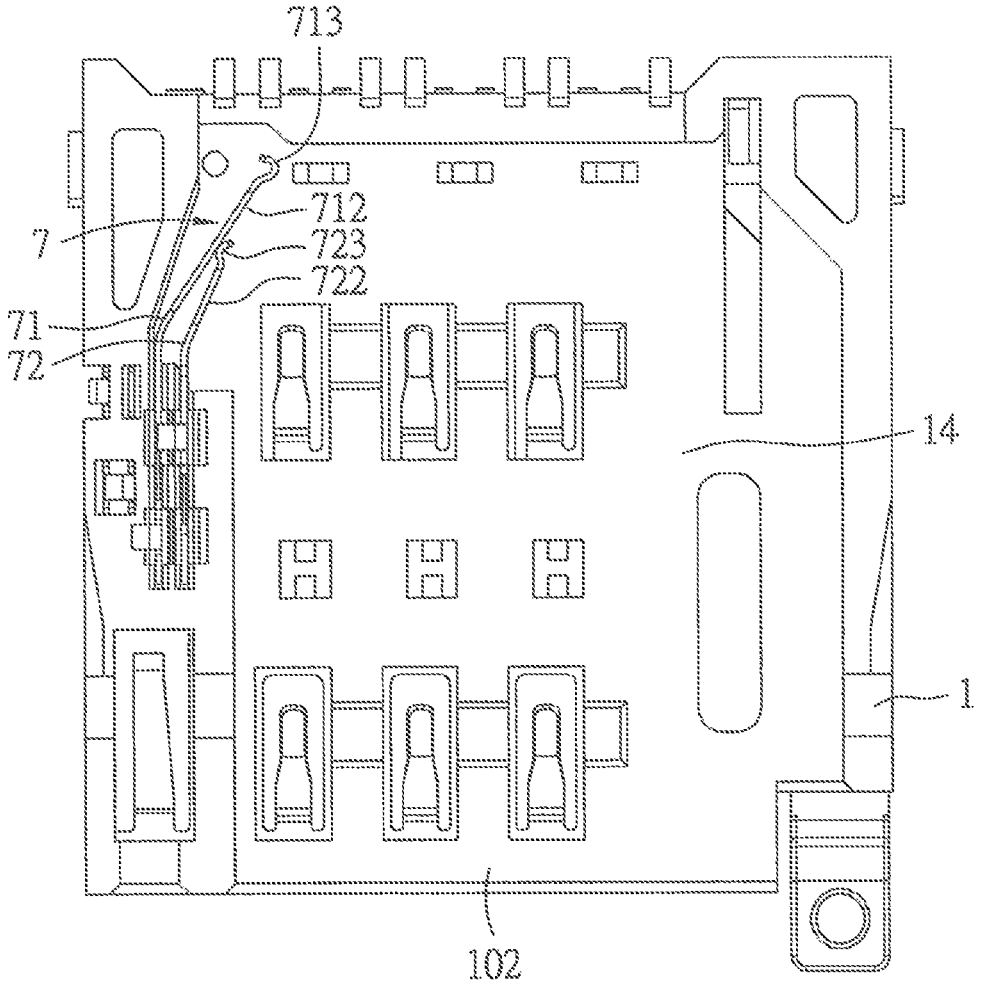
FIG. 12 are bottom views illustrating operative relationships between a second detection switch of the third embodiment and the electronic card.

The first detection switch 4 is provided to the housing 1 and is adjacent to a side of the first slot 101, the side extends along the card insertion direction I. The second detection switch 7 is provided to the housing 1 and is adjacent to a side of the second slot 102, the side extends along the card insertion direction I. In the embodiment, the first detection switch 4 and the second detection switch 7 are respectively provided to an upper surface 141 and a lower surface 142 of the spacer 14. If the insulative base 61 is a bottom plate which is integrally formed with the housing 1, the second detection switch 7 may be also provided to the bottom plate. Similarly to the first embodiment, the first detection switch 4 comprises a first resilient terminal 41 and a second resilient terminal 42, which are the same as the detection switch 4 of the first embodiment in structure and function (referring to FIG. 10 and FIG. 11), therefore the detailed explanation is omitted here. Similarly, the second detection switch 7 comprises a third resilient terminal 71 and a fourth resilient terminal 72. The third resilient terminal 71 has a third fixed portion 711, a third resilient arm portion 712, a third end portion 713 and a third soldering portion 714, and the third resilient terminal 71 is substantially the same as the first resilient terminal 41 in structure. The fourth resilient terminal 72 has a fourth fixed portion 721, a fourth resilient arm portion 722, a fourth end portion 723 and a fourth soldering portion 724, and the fourth resilient terminal 72 is substantially the same as the second resilient terminal 42 in structure. As shown in FIG. 12 and FIG. 13, the second detection switch 7 is the same as the first detection switch 4 in function, and is used to detect the electronic card 8 inserted into the second slot 102.

The card ejecting mechanism 5 is provided to a side opposite to the first detection switch 4 and the second detection switch 7, and may slide along the card insertion direction I, so as to eject the electronic card 8 from the first slot 101 and the second slot 102.

In conclusion, (the first) detection switch 4 comprises the two resilient terminals (the first resilient terminal 41 and the second resilient terminal 42), as in the normal state, the first resilient arm portion 412 of the first resilient terminal 41 abuts against the second end portion 423 of the second resilient terminal 42, most of the preloaded force exerted by the first resilient terminal 41 may be counteracted through elastic deformation of the second resilient terminal 42, so that the force exerted on the housing 1 may be reduced, so as to reduce risk of warpage of the housing 1 due to non-uniform force. Similarly, the second detection switch 7 comprises the two resilient terminals (the third resilient terminal 71 and the fourth resilient terminal 72), and similarly, most of the preloaded force exerted by the third resilient terminal 71 may be counteracted by the fourth resilient terminal 72, so as to reduce risk of warpage of the housing 1 due to non-uniform force, therefore, the object of the present disclosure can be achieved.

However, the above described are only the specific embodiments, which cannot limit the scope of the claims of the present disclosure, namely simple equivalent variations and modifications made according to the claims and the content of the present disclosure are still fallen within the scope of the claims of the present disclosure.

What is claimed is:

1. An electrical connector, comprising:

a housing having a front side and a rear side opposite the front side;

a cage engaged with the housing, the cage and the housing together defining a slot, and an entrance of the slot being adjacent to the front side so as to allow an electronic card to enter into and exit from the slot along a card insertion direction; and a detection switch provided to the housing and adjacent to a side of the slot, the side extending along the card insertion direction, and the detection switch comprising:

a first resilient terminal having a first fixed portion fixed to the housing and positioned outside the slot, a first resilient arm portion extending from the first fixed portion toward the rear side and offsetting toward the slot, and a first end portion extending from a distal end of the first resilient arm portion and extending into the slot and adjacent to the rear side; and a second resilient terminal having a second fixed portion fixed to the housing and positioned outside the slot, a second resilient arm portion extending from the second fixed portion toward the rear side and offsetting toward the slot, and a second end portion extending from a distal end of the second resilient arm portion, the second end portion being further adjacent to the front side relative to the first end portion, and when the electronic card is not inserted into the slot, the second end portion contacting the first resilient arm portion, when the electronic card is received in the slot, the first end portion being pushed by the electronic card and driving the first resilient arm portion to allow the first resilient arm portion to be separated from the second end portion.

2. The electrical connector according to claim 1, wherein the second end portion extends into the slot.

3. The electrical connector according to claim 1, wherein the first fixed portion and the second fixed portion respectively extend along the card insertion direction, and the second fixed portion is further adjacent to the slot relative to the first fixed portion.

4. The electrical connector according to claim 3, wherein the first resilient terminal further has a first soldering portion extending from the first fixed portion and extending out of the housing, the second resilient terminal further has a second soldering portion extending from the second fixed portion and extending out of the housing.

5. An electrical connector, comprising:

a housing having a front side and a rear side which are opposite and a spacer;

a cage engaged with the housing, the cage and the housing together defining a first slot and a second slot positioned respectively above and under the spacer, and an entrance of the first slot and an entrance of the second slot being adjacent to the front side so as to respectively allow an electronic card to enter into and exit from the first slot and the second slot along a card insertion direction;

a first detection switch provided to the housing and adjacent to a side of the first slot, the side extending along the card insertion direction, and the first detection switch comprising:

a first resilient terminal having a first fixed portion fixed to the housing and positioned outside the first slot, a first resilient arm portion extending from the first fixed portion toward the rear side and offsetting toward the first slot, and a first end portion extending from a distal end of the first resilient arm portion and extending into the first slot and adjacent to the rear side; and a second resilient terminal having a second fixed portion fixed to the housing and positioned outside the first slot, a second resilient arm portion extending from the second fixed portion toward the rear side and offsetting toward the first slot, and a second end portion extending from a distal end of the second resilient arm portion, the second end portion being further adjacent to the front side relative to the first end portion, and when the electronic card is not inserted into the first slot, the second end portion contacting the first resilient arm portion, when the electronic card is received in the first slot, the first end portion being pushed by the electronic card and driving the first resilient arm portion so as to allow the first resilient arm portion to be separated from the second end portion; and a second detection switch provided to the housing and adjacent to a side of the second slot, the side extending along the card insertion direction, and the second detection switch comprising:

a third resilient terminal having a third fixed portion fixed to the housing and positioned outside the second slot, a third resilient arm portion extending from the third fixed portion toward the rear side and offsetting toward the second slot, and a third end portion extending from a distal end of the third resilient arm portion and extending into the second slot and adjacent to the rear side; and a fourth resilient terminal having a fourth fixed portion fixed to the housing and positioned outside the second slot, a fourth resilient arm portion extending from the fourth fixed portion toward the rear side and offsetting toward the second slot, and a fourth end portion extending from a distal end of the fourth resilient arm portion, the fourth end portion being further adjacent to the front side relative to the third end portion, and when the electronic card is not inserted into the second slot, the fourth end portion contacting the third resilient arm portion, when the electronic card is received in the second slot, the third end portion being pushed the electronic card and driving the third resilient arm portion so as to allow the third resilient arm portion to be separated from the fourth end portion.

6. The electrical connector according to claim 5, wherein the first detection switch and the second detection switch are respectively provided to an upper surface and a lower surface of the spacer.

7. The electrical connector according to claim 5, wherein the second end portion extends into the first slot, the fourth end portion extends into the second slot.

8. The electrical connector according to claim 5, wherein the first fixed portion, the second fixed portion, the third fixed portion and the fourth fixed portion respectively extend along the card insertion direction, and the second fixed portion is further adjacent to the first slot relative to the first fixed portion, the fourth fixed portion is further adjacent to the second slot relative to the third fixed portion.

9. The electrical connector according to claim 8, wherein the first resilient terminal further has a first soldering portion extending from the first fixed portion and extending out of the housing, the second resilient terminal further has a second soldering portion extending from the second fixed portion and extending out of the housing, the third resilient terminal further has a third soldering portion extending from the third fixed portion and extending out of the housing, the fourth resilient terminal further has a fourth soldering portion extending from the fourth fixed portion and extending out of the housing.

* * * * *